US006349506B1

(12) United States Patent
Pace et al.

(10) Patent No.: US 6,349,506 B1
(45) Date of Patent: Feb. 26, 2002

(54) SHINGLE WITH INTEGRAL GUTTER SCREEN

(75) Inventors: Randy Eugene Pace, Wellford; Joshua Michael Runion, Taylors, both of SC (US)

(73) Assignee: Artistic View, Inc., Lyman, SC (US)

( * ) Notice: Subject to any disclaimer, the term of this patent is extended or adjusted under 35 U.S.C. 154(b) by 0 days.

(21) Appl. No.: 09/335,255

(22) Filed: Jun. 17, 1999

(51) Int. Cl.[7] ..... E04D 13/00
(52) U.S. Cl. ..... 52/12; 52/11; 52/13; 52/15
(58) Field of Search ..... 52/12, 11, 13, 52/15

(56) References Cited

U.S. PATENT DOCUMENTS

| | | | | |
|---|---|---|---|---|
| 546,042 | A | | 9/1895 | Van Horn |
| 1,313,742 | A | | 8/1919 | Schad |
| 1,613,101 | A | | 1/1927 | Harshberger |
| 2,045,707 | A | | 6/1936 | Hammersley |
| D175,561 | S | | 9/1955 | Olsson |
| 3,269,075 | A | | 8/1966 | Marini et al. |
| 3,426,488 | A | | 2/1969 | Stanford |
| 3,763,609 | A | | 10/1973 | Probst |
| 5,056,276 | A | | 10/1991 | Nielsen et al. |
| 5,216,851 | A | | 6/1993 | Kuhns |
| 5,339,575 | A | | 8/1994 | Kuhns |
| 5,471,798 | A | | 12/1995 | Kuhns |
| 5,555,680 | A | | 9/1996 | Sweers |
| 5,595,027 | A | * | 1/1997 | Vail ..... 52/12 |
| 5,729,931 | A | | 3/1998 | Wade |

* cited by examiner

*Primary Examiner*—Beth A. Stephan
*Assistant Examiner*—Patrick J. Chavez
(74) *Attorney, Agent, or Firm*—Dority & Manning, PA

(57) ABSTRACT

A gutter guard is provided which is constructed from a modified portion of roofing material. A bottom edge of the roofing material extends over the gutter and defines an upper series of openings and a lower series of openings. Beneath the upper and lower series of openings, a wire mesh is secured to the lower surface of the roofing material. The openings permit rain water to drain into the adjacent gutter while the mesh prevents unwanted debris from entering the gutter.

17 Claims, 3 Drawing Sheets

SHINGLE WITH INTEGRAL GUTTER SCREEN

FIELD OF THE INVENTION

This invention relates to a process and apparatus for maintaining gutters clear and unobstructed from organic matter such as leaves, twigs, pine needles, catkins, and similar debris which may otherwise clog a gutter or down spout. The invention is further directed to a gutter protector apparatus which is self-cleaning, maintenance free, long lasting, and is aesthetically pleasing.

In particular, this invention provides a durable gutter protector which is integral with roofing material such as a fiberglass, asphalt, wood, tile, or metal.

BACKGROUND OF THE INVENTION

A variety of gutter guards are known in the art for use in protecting gutters from becoming clogged with leaves or other debris. One such apparatus is provided in U.S. Pat. No. 5,056,276 to Nielsen et al. Nielsen teaches a gutter guard formed from an elongated flat sheet of perforated metal which is secured to the gutter by a number of clips. The clips are hinged to permit the gutter guard to pivot to facilitate cleaning. Nielsen further teaches the use of a dam to block or impede the flow of water across a portion of the gutter guard.

U.S. Pat. Nos. 5,339,575 and 5,216,851 to Kuhns teach a gutter guard in a form of a curved panel which directs rain water into a gutter through a plurality of raised lips. The guard is fastened directly to the gutter.

U.S. Pat. No. 5,729,931 to Wade teaches a wire mesh covering which overlies the guttering and is designed for use with a metal corrugated roof. The wire mesh clips to a portion of the gutter and provides a raised profile where the mesh is positioned relative to the roofing material.

U.S. Pat. No. 5,555,680 to Sweers teaches a gutter guard which is placed over the opening of a rain gutter. The guard provides a lip which engages an inner surface of the gutter and defines an upper surface having a plurality of circular holes which are designed to admit rain water and exclude leaves.

As will be seen from the description and illustrations to follow, none of the above-identified references discloses or anticipates certain aspects of the present invention directed towards a process and apparatus for preventing debris from entering the gutter and down spout system of a roof. Further, none of the references teach or suggest a gutter guard provide by a modified section of roofing material and which thereby maintains an attractive aesthetic appearance to the roof line. Further, the references do not suggest a self-supporting gutter guard provided by a modified shingle which provides a smooth, uninterrupted flow of rainwater into the gutter while excluding the entry of debris.

SUMMARY OF THE INVENTION

The present invention recognizes and addresses some of the limitations of prior art gutter guard processes and apparatuses. The present invention provides an improved apparatus and process of constructing a roofing system. The roofing system modifies a piece of roofing material, such as a shingle, to provide a portion of the roofing material which overlaps a gutter. The region of the roofing material which overlaps the gutter defines a plurality of openings which permit rain water to drain into the gutter. A lower surface of the overlapping portion of roofing material is in integral contact with a mesh which extends beneath the lower openings. In this manner, rain water may freely drain through the openings and mesh and enter into the gutter while leaves, sticks, needles, and other organic debris is excluded by the lower mesh layer.

The present invention provides a protective guard for a gutter which is integral with the existing roofing material. Further, the roofing material, when modified in accordance with the present invention, provides a seamless, unobstructed flow for the rain water. There are no obstructions, clips, raised lips, or attachment points which may serve to alter the natural flow of water or serve as a trap for accumulating debris. As such, the roof assembly provides a self-cleaning mechanism whereby flowing water and wind serve to continuously clean and remove debris from the draining edge of the roof assembly.

An additional advantage of the roofing assembly is that the gutter guard provided by the modified roofing material is self-supporting and requires no separate attachment other than the standard installation techniques used to secure the roofing material. The inherent stiffness of the roofing material combined with the reinforcing properties of the underlying mesh provide a gutter guard having sufficient strength and permanence to maintain a proper position without the need of separate clips or internal attachment points within a gutter.

The roofing system further maintains an aesthetic and attractive roof profile. By modifying the existing roofing material to construct a gutter guard, the end result is more aesthetically pleasing than conventional after market attachments clips and panels. An additional feature of the present invention is that roofing materials which are supplied in large continuous rolls, i.e., roll roofing, can be modified in accordance with this invention and thereafter supplied in the form of a continuous roll. The modified roofing material can be cut using standard knives and blades to provide a customized fit on a new roof installation. Further, an existing roof structure may be modified by the addition of a terminal layer of roofing material which has been modified to provide the apertures and underlying mesh opposite the gutter.

Where environmental extremes such as high wind or heavy snowfall accumulations are present, the modified roofing material may have a variety of reinforcing features incorporated into the end product. However, for all the embodiments described below, the resulting modified roofing material provides a self-supporting gutter guard which does not rely upon any mechanical attachment to the gutter. Rather, the structural strength of the modified roofing material supports the mesh openings in proper position above the gutter. In so doing, the mesh prevents the entry of small debris and twigs which are unsightly and are difficult to remove from other gutter guards and which often have raised lips, accessible openings, or projections upon which debris may become lodged or attached.

DETAILED DESCRIPTION OF A PREFERRED EMBODIMENT

It is to be understood by one of ordinary skill in the art that the present discussion is a description of exemplary embodiments only, and is not intended as limiting the broader aspects of the present invention, which broader aspects are embodied in the exemplary construction.

As defined herein, the term "mesh" includes a screen-like material as seen in reference to the figures and which may be provided by metal wire such as steel wire, aluminum wire, plastic-coated wire, or a plastic or fibrous mesh, or a fiberglass mesh. Further, the term "mesh" as used herein further includes any porous material which will permit the largely unimpeded passage of rain water through the material while preventing the entry or attachment of organic debris such as leaves, sticks, and needles. Other mesh materials consistent with this definition may include geotextile fabrics, nonwoven porous fabrics, coated porous fabrics, sieve-like plates formed from plastic or metal sheets, and other highly porous materials which admit rain water while excluding other debris. Preferably, the mesh has sufficient porosity to permit the passage through the mesh of the grit or chat stone material commonly used in shingle construction so as to avoid clogging the mesh material. The fine size of the grit/chat does not interfere with the normal operation of the gutter and downspout system.

Figure 1:
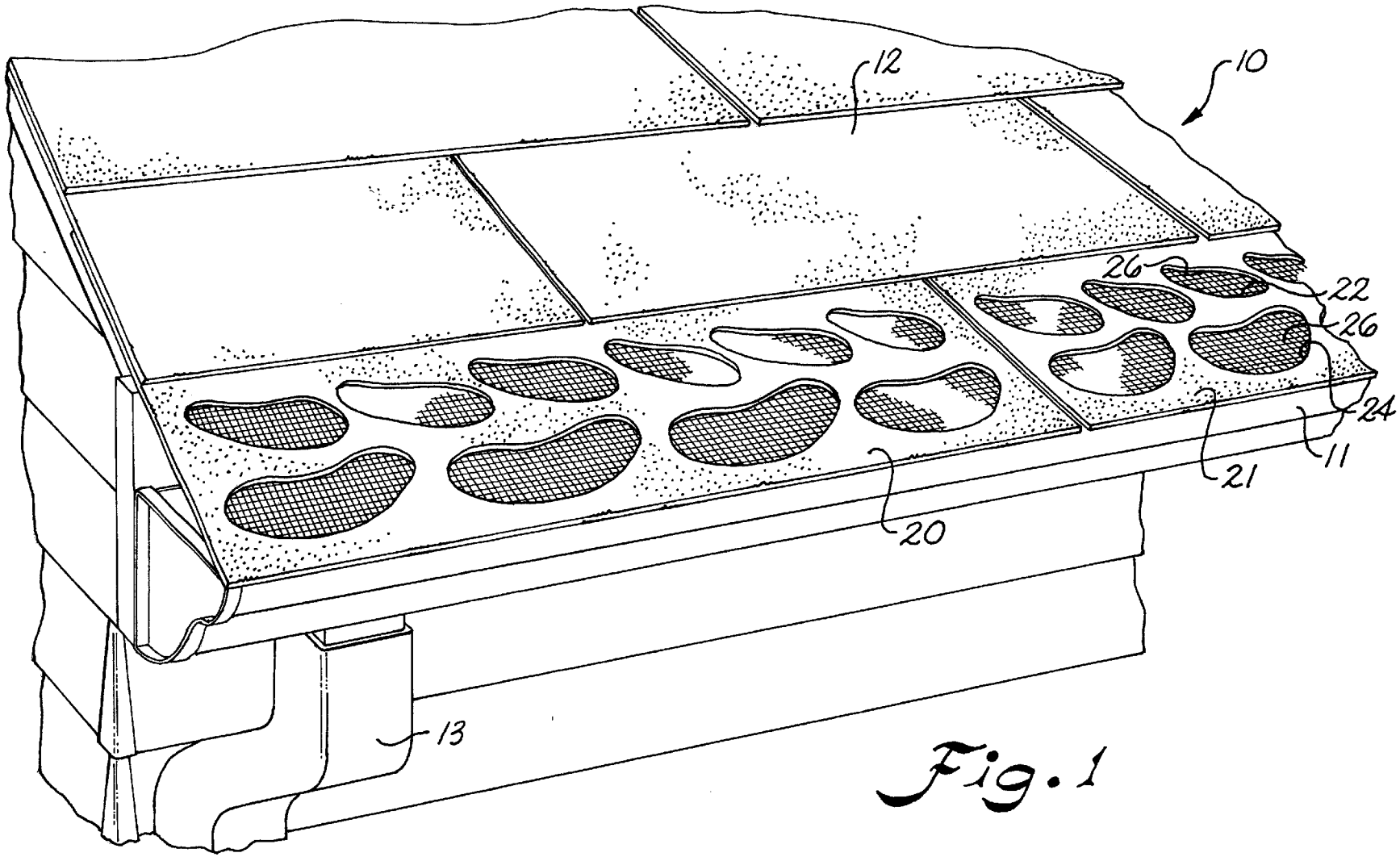
FIG. 1 is a front perspective view of a roofing system setting forth details of one embodiment of the present invention.

Turning now to the figures, FIG. 1 illustrates a roof structure comprising a plurality of overlapping shingles 12. Shingles 12 may be provided from fiberglass shingles, asphalt shingles, continuous roll roofing material, wooden shingles, slate shingles, as well as metal sectional roofing material. The roof assembly defines a gutter 11 along a lowermost edge of the roof. Gutter 11 provides a trough-like passage for rain water which enters downspout 13 which then directs the rain water away from the foundation of the building.

As seen in FIG. 1, a lowermost shingle 20 is attached to the roofing structure in a typical fashion. A lower margin of the shingle extends over the gutter opening and defines an upper series of openings 22 and a lower series of openings 24. As seen in reference to the figures, the lower series of openings 24 are spaced opposite from and overlap the upper shingle surfaces present between the upper series of openings. This preferred overlap facilitates the collection and passage of rain water runoff from the roof and into the overlapping series of apertures.

Beneath each aperture is a mesh material positioned beneath the aperture. Preferably, the mesh material has sufficient strength to withstand the environmental extremes of an exposed roofing environment. Steel mesh is preferred for typical residential asphalt or fiberglass shingles in that the steel mesh offers reinforcement to the lower margin of the shingle. The additional reinforcement provided by the mesh has been found useful to prevent strong winds from lifting or bending the edge of the shingle. Further, in climates with large annual snow accumulations, the reinforcement helps the shingle bear the weight of accumulated snow.

Figure 2:
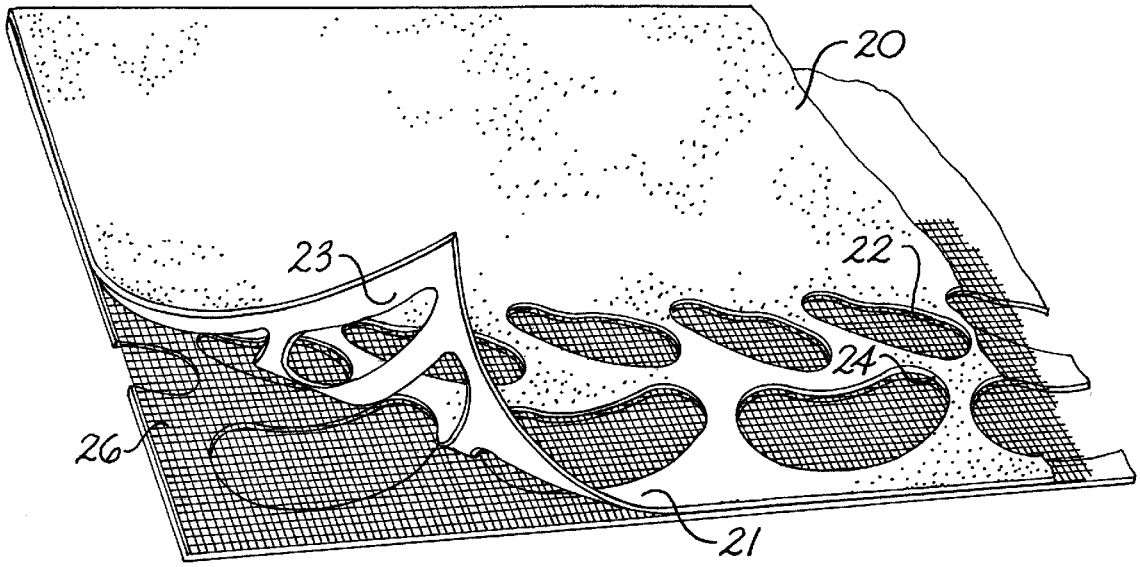
FIG. 2 is a perspective view of a section of roofing material as modified in accordance with the present invention.

One method of construction of a modified roofing material according to the present invention is seen in reference to FIG. 2. An upper surface 21 of shingle 20 is secured to mesh 26. Mesh 26 need not extend beneath the entire lower surface of shingle 20 but may be placed opposite the lower margins so as to overlap apertures 22 and 24. Mesh 26 is preferably secured to a lower surface of shingle 20 through any suitable adhesive or attachment mechanism.

Figure 3:
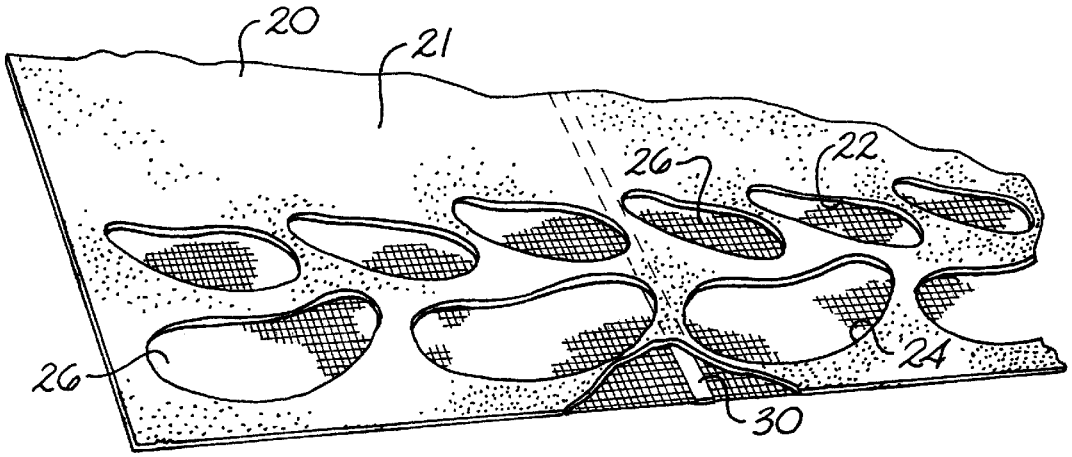
FIG. 3 is a front perspective view of a section of roofing material setting forth additional details of construction.

As seen in reference to FIG. 3, the shingle 20 as constructed in accordance with the present invention provides a lower mesh layer 26 which is securely attached to a lower surface 23 of shingle 20.

An optional structural reinforcement member 30 at periodic locations between the mesh 26 and lower shingle surface 23. The reinforcing member may be provided from a rigid strip of plastic, metal, or similar material.

Figure 4:
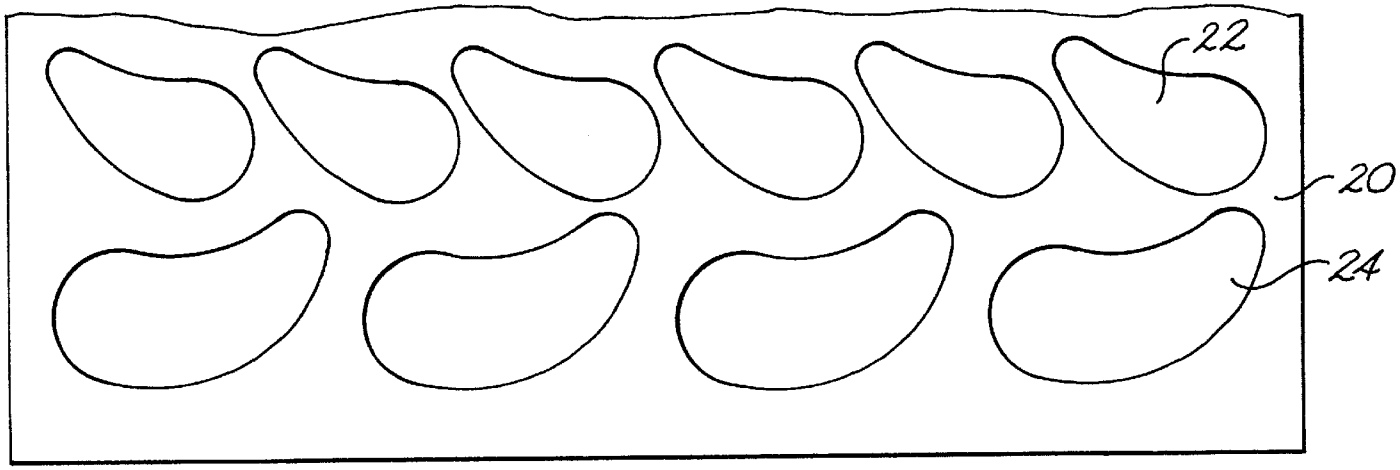
FIG. 4 is a schematic view setting forth one embodiment of geometric openings present in the roofing material.
Figure 5:
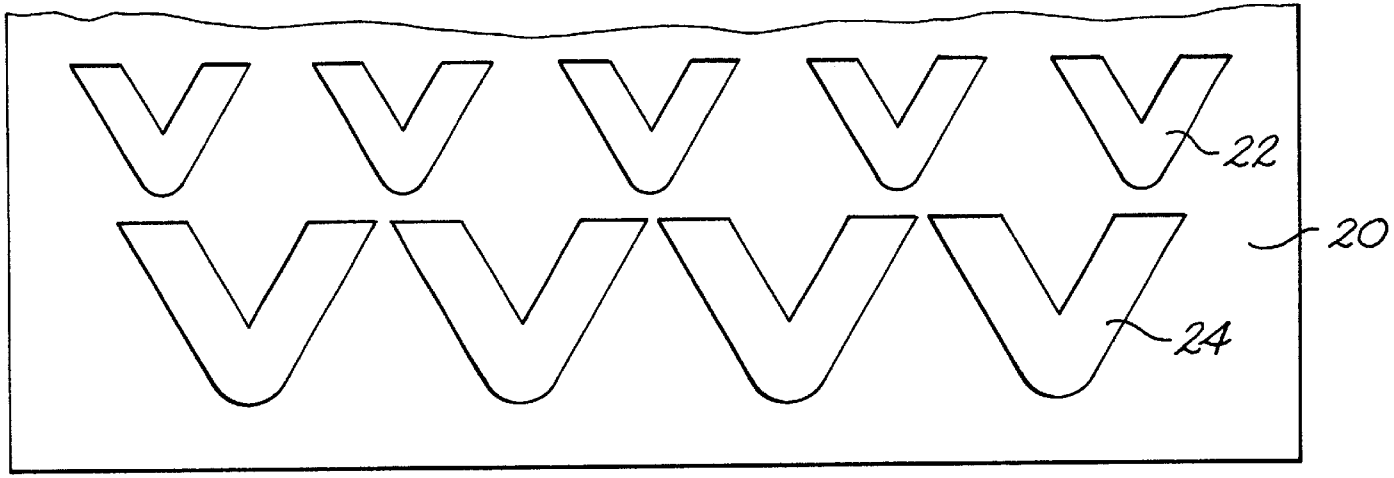
FIG. 5 is a schematic view setting forth a variation of geometric openings defined by the roofing material.

As seen in reference to FIG. 4, the upper series of openings 22 and the lower series of openings 24 can be provided by similar geometric shapes seen here in the form of an oblong teardrop shape. As seen in FIG. 5, a similar pattern of different geometric shapes as seen in the form of an upper series of chevron openings 22 and a lower series of chevron openings 24 may be provided. A repeating pattern of openings in which the lower series of openings overlap with runoff sections between the upper series of openings is believed to provide the best possible drainage of rain water. It is believed that a wide variety of patterns and shapes may be provided which achieve the necessary drainage. Further, while repeating patterns are preferred in terms of presenting an attractive and ornamental appearance to the product and the resulting roof system, a series of random openings could also be provided within a lower margin of the roofing material to achieve an equivalent functional result.

It is also envisioned that a single contiguous opening could be provided which extends along all or a majority of the length of the shingle. Such an opening could extend laterally across the shingle as a straight opening or define a more serpentine, curved pattern. However, a single opening tends to weaken the strength of the resulting modified roofing material. For this reason, the overlapping patterns described herein may offer a better design choice.

Preferably, the openings 22 and 24 are formed by stamping or cutting the roofing material at the desired location. This is particularly useful for thin roofing materials such as asphalt or fiberglass shingles. Following the formation of the openings, the mesh layer 26 which underlies the openings may be secured to the shingle by an adhesive. One desirable way of attaching the mesh to a lower surface of the shingle is to press the mesh into the heated, softened lower surface of the shingle during the construction of the shingle. For instance, an asphalt shingle is constructed typically having a base layer of a tar-like, thermoplastic web material which softens upon exposure to heat. When so heated, a roller or other type press may be used to press the mesh material into the thermoplastic substrate of the base layer, the substrate having defined therein the openings 22 and 24. Upon cooling, the mesh is held in position by the hardened base layer material and the upper shingle layers may thereafter be applied to the base portions of the shingle surrounding the openings 22 and 24.

If desired, the lowermost shingle 20 may be provided from a double thickness of overlapping shingle-material with the mesh secured as described above. The double thickness, if provided by multiple layers, would further allow the mesh to be sandwiched between the opposing layers of the shingle material. In such an embodiment, openings 22 and 24 may be formed through both layers of the overlapping material. Following the formation of the apertures, the mesh 26 may be inserted between the upper shingle member and the lower shingle member of the double shingle and secured in position. While such a shingle is more expensive to construct, the double thickness provided by the shingle adds additional strength and rigidity to the lower margin of the shingle and extends the life span of the shingle. Further, the sandwich-type arrangement provides an additional securing mechanism to hold the mesh 26 in operative engagement with the openings 26 and 24.

One advantage of the roofing system of the present invention is that the modified roofing material 20 is attached to the roof structure in a manner identical to the normal roofing shingles 12. This attachment does not require any additional skill or materials to carry out the installation of the roofing system. An additional advantage is that the gutter is provided with a protective covering which freely admits rain water but prevents the passage of other debris which may obstruct the gutter or downspout and lead to leakage from the roof or damage to the roof underlayment.

In particular, positioning the mesh along the lower surface of the roofing material maintains a smooth profile of the upper surface of the roofing material. The smooth profile has been found useful in the effective flow of rain water and promotes the self-cleaning of the covered gutter area by the flushing action of the rain water and wind. If desired, a small bead of an adhesive or caulk-like material may be placed along the perimeter of the outer opening in proximity to the adjacent underlying mesh. This small bead will further serve to prevent debris from becoming wedged between the mesh and an edge of the openings.

The teardrop shape of openings 22 and 24, as best seen in FIGS. 1–4, has been found to be particularly useful in flushing away debris which may be present opposite the mesh 26 and the corresponding opening. The drainage pattern of the water, as it travels the curved edges of the openings 22 and 24, helps to flush debris from the openings.

Unlike other gutter guard attachments or accessories, the present invention provides no obstruction, clips, mounting accessories or edges to interfere with the natural flow of the rain water or which serve to catch debris. Rather, the roofing assembly as represented by the modified shingle 20 provides a protective gutter portion which is contiguous with the remainder of the roofing materials and provides a substantially seamless union between the protective gutter feature and the protective roofing material. As a result, there is no transition point, break, or discernable structure through which leakage or debris may accumulate.

The present roofing assembly has been found to provide an effective apparatus for protecting a gutter which is also self-cleaning. The force of draining rain water in combination with wind action will provide a self-clearing feature for leaves and other debris which accumulates on the roof. The same flushing action of wind and rain which would normally wash the debris into the gutter simply directs the debris off the lower edge of the roof line. As a result, the present roofing system permits a virtually maintenance-free system for keeping the gutters and downspouts free of debris.

The present invention is ideally suited for installation whenever a new roof or layer of shingles is installed to an existing roof. However, a series of modified shingles 20 can be added to an existing roof by inserting an upper edge of shingle 20 beneath the lowermost edge of the previously installed shingle. Once the shingles 22 are properly positioned so that apertures 26 and 24 are opposite the gutter opening, the shingle 22 may be nailed into place.

It is well known within the art of roofing materials to supply roll roofing in the form of a continuous sheet of asphalt or fiberglass shingle material. It is envisioned that a continuous roll of a modified roofing material in accordance with this invention may be similarly provided. Large continuous rolls would be useful in both the installation of a new roof as well as in the retrofitting of an existing roof. The components of the illustrated and preferred embodiments of the invention are easily cut to a desired size using a utility blade or tin snips.

An additional advantage of the modified shingle of the present invention is that the gutter guard is maintained in a permanent secured position relative to the gutter. The present invention requires no removal or displacement of the gutter guard, unlike the teachings of certain prior art gutter protector systems. The preferred mesh material is a corrosion resistant, structurally sound material which has a durability and a life expectancy equal to that of the roofing material. Accordingly, a single installation provides protection for the gutters and roof drainage system which is permanently in place for the life of the roofing material.

The mesh covered opening also permits ventilation of the gutter and structural roof line so as to avert excess moisture which could damage the structural wood roof components.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. An apparatus for preventing leaves and debris from entering into a gutter at a lower edge of a roof comprising:

a roofing shingle having a top surface, a bottom surface, an upper margin and a lower margin, the lower margin defining an opening between the top surface and the bottom surface, the upper margin adapted for flush engagement to a roof board and further adapted for securement beneath an adjacent shingle, said upper margin and said lower margin being coplanar;

a mesh supported by the roofing shingle and traversing the opening;

wherein, the lower margin of the roofing shingle is adapted to be positioned opposite a gutter, the opening allowing rain water to pass into the opening and through the mesh while the mesh prevents the passage of debris therethrough.

2. A shingle comprising:

a substantially flat sheet of roofing material having a top surface, a bottom surface, an upper margin and a lower margin, the lower margin defining a plurality of openings between the top surface and the bottom surface, the upper margin adapted for engagement between a roof board and an adjacent shingle covering the roof board; a mesh substrate attached to the lower surface of the shingle and extending past the plurality of openings.

3. The shingle according to claim 2, wherein the substantially flat sheet of roofing material is selected from the group comprising an asphalt shingle, a fiberglass shingle, a steel shingle, a wooden shingle, and a slate shingle.

4. The shingle according to claim 2 wherein the mesh substrate is selected from the group comprising a wire mesh, a plastic mesh, a fabric web, a fabric net, a geotextile fabric, and a sieve-like plate.

5. The shingle according to claim 2 wherein the mesh substrate is adhesively bonded to a bottom surface of the shingle.

6. The shingle according to claim 2 wherein the openings defined by the shingle further comprise an upper series of linearly spaced openings and a lower series of linearly spaced openings.

7. The shingle according to claim 6 wherein the lower series of openings are each spaced opposite a respective margin defined between the upper series of openings.

8. The shingle according to claim 2 wherein the plurality of openings define a random pattern along the lower margin of the roofing material.

9. The shingle according to claim 2 wherein the flat sheet of roofing material is supplied in the form of a continuous roll.

10. The shingle according to claim 6 wherein the upper series of linearly spaced openings forms a repeating geometric pattern.

11. The shingle according to claim 10 wherein the lower series of linearly spaced openings is formed by a repeating geometric shape.

12. The shingle according to claim 11 wherein the upper and the lower series of linearly spaced openings have substantially similar geometric shape.

13. The shingle according to claim 2 wherein the mesh substrate is attached to the lower surface of the shingle by an additional layer of said roofing material positioned on an opposite side of the mesh.

14. A process of providing a roofing structure comprising:

providing a layer of roofing material extending over a plurality of roof boards of a structure;

positioning a gutter adjacent a lower edge of the structure;

securing an additional layer of roofing material to said plurality of roof boards, a section of said additional roofing material overlapping the gutter;

providing a series of apertures within the overlapping section of the roofing material and above the gutter opening;

placing a mesh covering along a bottom surface of said layer of roofing material and which extends across said series of apertures;

wherein the openings and the underlying mesh allow entry of rain water into the gutter while preventing the introduction of debris.

15. The apparatus according to claim 1, wherein the shingle further defines a plurality of openings along a lower margin of the shingle, each of the openings further having a mesh disposed opposite the openings.

16. The shingle according to claim 1 wherein said roofing shingle is selected from the group consisting of an asphalt shingle and a fiber glass shingle, and said mesh is a wire mesh adhesively bonded to the bottom surface of the roofing shingle.

17. The shingle according to claim 2 wherein said flat sheet of roofing material is selected from the group consisting of an asphalt shingle and a fiber glass shingle, and said mesh substrate is a wire mesh adhesively bonded to the bottom surface of the shingle.

* * * * *